United States Patent [19]

Visconti et al.

[11] 4,201,042

[45] May 6, 1980

[54] REGULATOR FOR A TIMEPIECE MOVEMENT

[75] Inventors: Gérald Visconti, Bellach; Beat Gilomen, Biel, both of Switzerland

[73] Assignee: A. Schild S.A., Grenchen, Switzerland

[21] Appl. No.: 901,810

[22] Filed: May 1, 1978

[30] Foreign Application Priority Data

May 12, 1977 [CH] Switzerland ..... 5983/77

[51] Int. Cl.[2] ..... G04B 17/13

[52] U.S. Cl. ..... 368/170; 368/176

[58] Field of Search ..... 29/177, 178; 58/28, 58/107-115, 117, 116 R

[56] References Cited

U.S. PATENT DOCUMENTS

| | | | |
|---|---|---|---|
| 3,429,119 | 2/1969 | Tamaru | 58/113 |
| 3,540,211 | 11/1970 | Thompson et al. | 58/109 |

FOREIGN PATENT DOCUMENTS

| | | | |
|---|---|---|---|
| 257460 | 4/1949 | Switzerland | 58/109 |
| 272612 | 3/1951 | Switzerland | 58/109 |
| 310282 | 12/1955 | Switzerland | 58/109 |
| 332886 | 9/1958 | Switzerland | 58/113 |
| 333247 | 10/1958 | Switzerland | 58/113 |
| 364457 | 5/1962 | Switzerland | 58/109 |
| 366242 | 1/1963 | Switzerland | 58/109 |
| 1162673 | 8/1969 | United Kingdom | 58/115 |

*Primary Examiner*—Vit W. Miska

*Attorney, Agent, or Firm*—Stevens, Davis, Miller & Mosher

[57] ABSTRACT

A regulator comprising two limiting members in the form of a blanked and bent tongue of a lug and of a detachable part serving as a pin or key, respectively. Part of the side surface of the tongue bent at a 90° angle projects to form a banking. The detachable limiting member, which can be rotatingly adjusted about its axis, is fitted in the entrance opening of a cut-out portion and includes a projecting edge constituting the other banking. The two bankings are visible from above between the side surface of the bent tongue and the entrance opening of the cut-out portion so that the regulation of the beat of the balance-spring can be checked under a microscope.

8 Claims, 8 Drawing Figures

REGULATOR FOR A TIMEPIECE MOVEMENT

Figure 1:
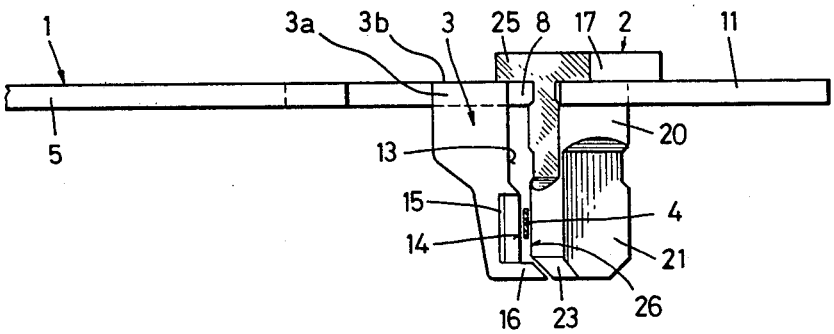

This invention relates to a regulator for adjusting the active length of a balance-spring in a timepiece movement.

Most wrist watches are equipped with regulators bearing limiting members which are either fixed or have only restricted possibilities of adjustment. When such limiting members are precisely machined and carefully fitted, they provide good conditions for regulating the rate of the watch.

In some watches there are special regulators, the limiting members of which can be displaced with respect to one another or positioned differently with respect to the blade of the balance-spring, thereby making it possible to adjust the play of the balance-spring and to fit the latter in place when it is pinned up to its stud.

Quite often, these special regulators are either very complicated or do not offer all the advantages attributable to conventional regulators, particularly in that they do not ensure retention of the balance-spring in the case of a shock. Thus, Swiss Pat. No. 272,612 describes a regulator in which the limiting members consists of a fixed pin and an arcuate key which extends at a tangent to the balance-spring and is fitted on the lug of the regulator in such a way that the banking element of this key moves radially away from the pin when the key is rotated. The difficulty of fitting such limiting members is as least as great as for a conventional key and pin.

A different arrangement is proposed in Swiss Pat. No. 257,460. There, the regulator is combined with the studsupport, and a single limiting member is fitted near one end of a resilient arm bearing a screw which presses radially against a banking. The zone of contact between the balance-spring and the limiting member is visible from the outside when the movement is viewed from above; but this system comprises only one limiting member, so that the accuracy of adjustment is not the same as that obtained by means of conventional regulators.

Swiss Pat. No. 364,457 discloses an improved regulator which likewise comprises a single limiting member disposed outside the balance-spring and continuously adjustable radially. However, the banking element is a cylindrical surface having a relatively large radius, and fitting is carried out in such a way that the zone of contact between the banking element and the balance-spring is not visible when timing corrections are made.

Hence the conventional arrangement, in which the limiting members are a key and a pin, remains a solution considered advantageous. It is, however, relatively troublesome as regards manufacture and fitting. It offers certain possibilities of adjustment, although requiring long experience and quite some skill on the part of the personnel responsible for carrying out corrections. The manufacture of regulator pins and keys, as well as their fitting, continues to be subject to drawbacks deriving from the tolerances of mass-production, so that if it is desired to effect a very precise adjustment of the daily rate conditions of the balance-spring, delicate individual corrections remain necessary.

It is an object of this invention to provide an improved regulator which is more simple to manufacture than conventional regulators, which can be manufactured and fitted under the best possible conditions of accuracy, and which allows timing corrections to be carried out systematically and easily at the time of the spring-checking operation.

To this end, in the regulator according to the present invention, of the type having an annular portion to be fitted on the timepiece movement coaxially with the balance-spring, a lug having a cut-out portion and an opening into the cut-out portion, and a first limiting member fitted in the cut-out portion and held rotatingly adjustable about an axis parallel to the axis of rotation of the regulator, the improvement comprises a second limiting member disposed opposite the first limiting member and formed by a lateral portion of the lug bent in a rounded bend, about a line running towards the opening into the cut-out portion, into a plane parallel to the axis of rotation of the regulator; and at least two straight, parallel, projecting banking elements respectively forming part of the first and second limiting members, the banking elements being visible between the opening and the rounded bend when viewed at right angles in the dial-down position of the movement.

This arrangement presents the advantage of allowing systematic corrections to be made at the time of spring-checking by observing the clearance between the limiting members and by checking the beat of the balance-spring with the aid of a microscope.

Figure 2:
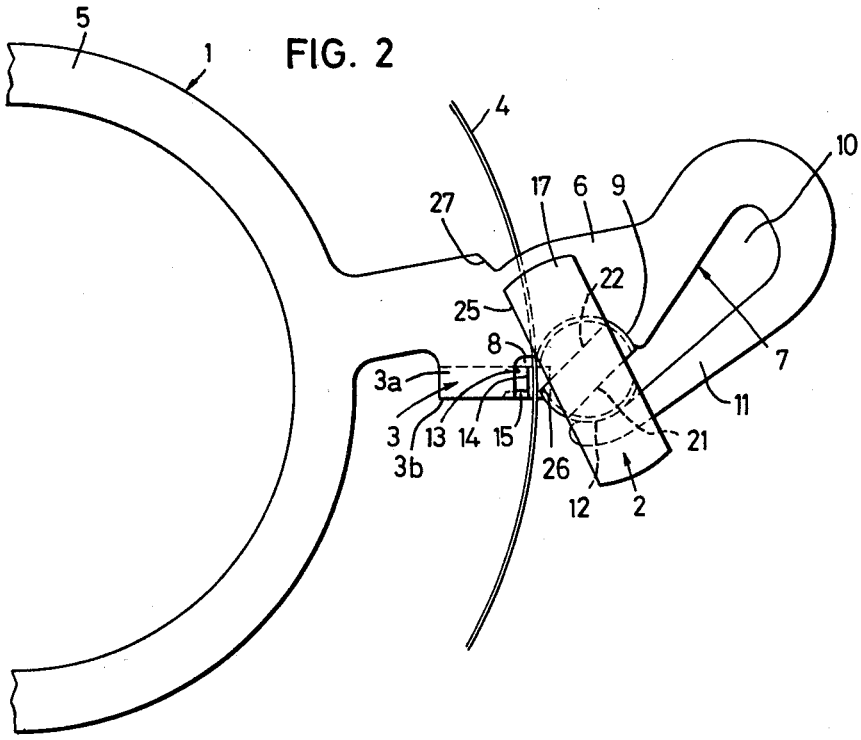
Figure 3:
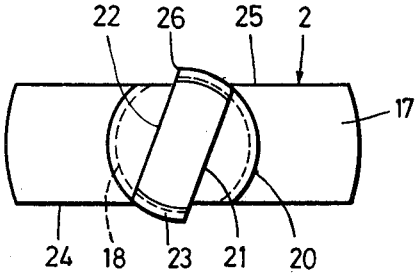
Figure 4:
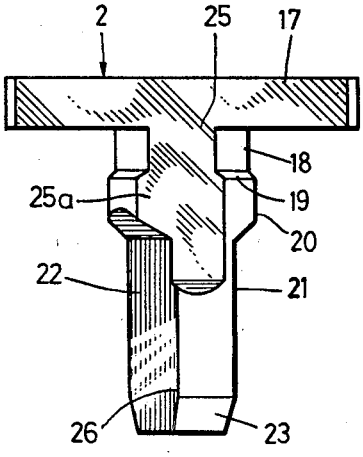
Figure 5:
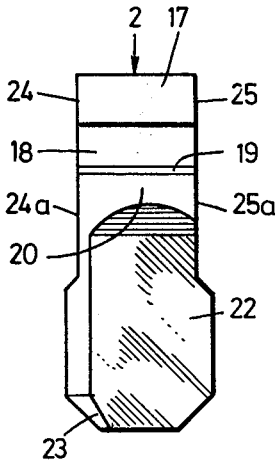
Figure 6:
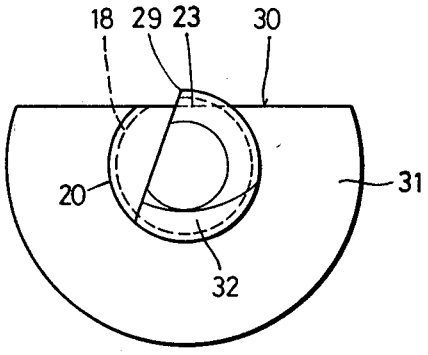
Figure 7:
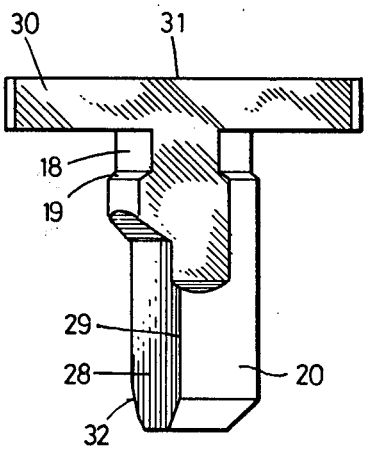
Figure 8:
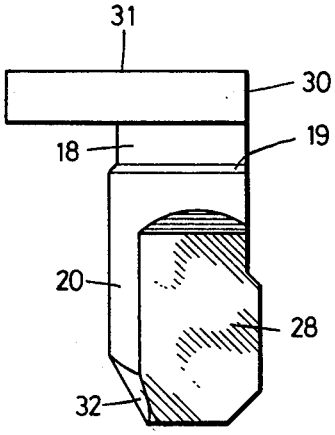

A preferred embodiment of the invention and a modification thereof will now be described in detail with reference to the accompanying drawings, in which:

FIGS. 1 and 2 are a partial elevation and top plan view, respectively, of an embodiment of the regulator according to the invention, FIGS. 3, 4 and 5 are respectively an end-on view, an elevation, and a side elevation of one of the limiting members of the regulator of FIGS. 1 and 2, on a larger scale, and FIGS. 6, 7,and 8 are views analogous to FIGS. 3, 4, and 5 of a modification of the same limiting member.

FIGS. 1 and 2 show a regulator comprising a body 1, a pin 2, and a key 3, with the outer turn of a balance-spring 4 engaged between the limiting members 2 and 3. The regulator body includes an annular part 5, intended to be fitted on a cylindrical pivoting surface of a bearing or of an upper endpiece, and a lug 6. The body 1 is blanked from a thin metal plate and may be provided with a tail or pointer (not shown) or, as a variation, with a driving element cooperating with other members of a precision-timing device.

The inner limiting member, in the form of the key 3, is made in one piece with the lug 6 of the regulator body 1 by blanking a tongue to extend out from one side of the lug 6 and bending it through 90° about a line **3*b* to form a rounded bend 3*a*, so that the key 3 lies in a substantially radial plane parallel to the axis of rotation of the regulator. The part of the lug 6 which extends beyond the tongue forming the key 3 includes a cut-out portion or slot 7 having an entrance opening 8, a first arcuate sector 9, an elongated portion 10 delimiting a resilient arm 11, and a second arcuate sector 12 situated at the end of the arm 11. All these parts may be produced during the same blanking operation. One side of the opening 8 continues into a side surface 13 of the tongue forming the key 3, extending perpendicular to the line 3*b* along the portion forming the bend 3*a*, so that after bending the side surface 13 is parallel to the axis of rotation of the regulator. Continguous with the side surface 13 is a banking element 14 forming the fixed functional element intended to cooperate with the balance-spring 4. The banking element 14 projects slightly with respect to the side surface 13, parallel to the latter. To give the element 14** this protruding aspect, a recess 15 is stamped in the edge of the tongue forming the key 3 at the time of the blanking operation. As a result of this conformation, the banking element 14 is visible when the regulator is viewed from above, as seen in FIG. 2. Projecting from the lower end of the key 3 is a rim 16 acting as a retaining element which prevents the balance-spring 4 from jumping out of place in the event of a shock.

Instead of being positioned along a radial plane, the limiting member 3 might be bent along a line 3*b* such that it would be positioned at an angle to the radius of the balance-spring. Thus, the member 3 might be slanted at an angle of up to 45°. In this case, the banking element 14, which, in the embodiment described, is a narrow surface tangent to the balance-spring, would be reduced to a simple edge.

The outer limiting member 2 is a pin which may be manufactured by profile-turning and put in place by being fitted from above into the space between the arcuate sectors 9 and 12. It is then held in a fixed position by elastic gripping.

The various elements of the pin 2 are shown in FIGS. 3, 4, and 5. They include at the upper end of the part 2 an elongated head 17 intended to rest upon the lug 6. Projecting from the head 17 is a generally cylindrical stem comprising various bearing surfaces and provided with various flats. This stem comprises first of all an engagement bearing surface 18 adapted with a slight excess of diameter to the diameter of the arcuate sectors 9 and 12. The length of the bearing surface 18 is slightly less than the thickness of the regulator body 1, so that a cone 19 contiguous with the bearing surface 18 cooperates with the lower edges of the sectors 9 and 12 to ensure that the pin 2 is held quite perpendicular to the regulator body 1.

A cylindrical bearing surface 20 following the cone 19 is notched by two parallel flats 21 and 22 extending to the end of the pin 2 and by an end cone 23 which facilitates the fitting of the pin 2 and prevents snagging of the balance-spring in the event of a shock. Furthermore, the head 17 is bounded by two parallel, longitudinal side faces 24 and 25 which are spaced from one another at a distance which is less than the diameter of the bearing surface 18. The faces 24 and 25 continue into the two bearing surfaces 18 and 20 by means of flats 24*a* and 25*a*. Moreover, the positioning of the faces 24 and 25 with respect to the flats 21 and 22 is such that these planes form between them an angle of 55°–65°, preferably about 60°, as may be seen from FIGS. 2 and 3. As a result, when the pin 2 is fitted as shown in FIG. 2, an edge 26 delimited by the flat 22 in the cylindrical surface of the bearing surface 20 is limited by the flat 25*a* and is consequently visible in the direction of the axis of the regulator. On the other hand, because of the entrance opening 8 of the cut-out portion 7, the banking element 14 is likewise visible in the same direction, so that when the pin 2 is in place, the beat of the balance-spring can be observed from the bridge side between the banking elements 26 and 14 by means of a microscope.

The blanked lug 6 is provided with a guide-mark 27 represented by a small notch situated along the outer edge of the lug 6. The location of the guide-mark 27 is such that it indicates the proper orientation of the head 17 in order that, normally, the elements 26 and 14 may be in optimum relative positions. Regulators bodies 1 may thus be delivered with the pins 2 fitted into the arcuate sectors 9 and 12 but turned so as to leave a wide space between the elements 26 and 14, which will facilitate putting the balance-spring in place. The pins 2 will then be rotated to bring the heads 17 into the position indicated by the guide-mark 27, after which the beat conditions must be observed under a microscope, and a final adjustment of the banking elements can be made.

In the modification illustrated in FIGS. 6, 7, and 8, the same essential elements of the limiting pin are to be found. However, the cylindrical bearing surface 20 exhibits only one undercut formed by a single flat 28 delimiting a functional edge 29, whereas the upper part of the stem with the cone 19 and the cylindrical bearing surface 18 likewise exhibits only a single flat 30 disposed at an angle with respect to the flat 28 and forming the side face of a more or less crescent-shaped head 31. The angle between the two flats 30 and 28 will be about the same as between the flats 24 and 21 or 22 and 25 of the pin 2 previously described. In order to prevent snagging of the balance-spring in the modification illustrated in FIGS. 6, 7, and 8, there is provided on the outer side a conical surface 32 extending to the end of the stem of the pin. This pin will be fitted and adjusted in exactly the same way as the pin 2.

It should be noted that in another embodiment, the relative arrangements of the members 2 and 3 might also be reversed.

The regulator described above presents numerous advantages.

First of all, it can be used as a replacement on any watch previously equipped with a conventional regulator.

Secondly, whereas conventional regulators are made up of three parts, viz., the body, the key, and the pin, the regulator according to the present invention comprises only two different parts, and assembly is simpler than in the conventional case.

Thirdly, adjustment of the regulator is a much easier operation to carry out than with a conventional regulator. It is easy to seize the head of the pin by means of a tool in order to rotate it about its axis; and owing to the possibility of observing the beat of the balance-spring under a microscope, optimum regulation can be obtained.

In particular, if the regulator is used in a watch provided with a rotatingly adjustable stud, it is possible to adjust the stud at the time of spring-checking so that the blade of the balance-spring passes exactly midway between the limiting members. If so desired, the amount of play can be adjusted to zero, or the balance-spring can even be gripped between the limiting members without being deformed in any way. This latter condition will be facilitated by the appropriate choice of the position of the axis of the part 2 with respect to the banking element 14. It is therefore possible to obtain operating conditions of the balance-spring which are ideal in every case and hence to improve still further the running qualities of wrist watches, thus emphasizing to the maximum the particular qualities of a movement, especially its regularity of rate and its lack of sensitivity to variations of position.

Finally, the regulator according to the present invention is of robust construction, the elements being connected to one another in such a way as to be shock-resistant, being small in size, and being designed to prevent snagging of the balance-spring.

What is claimed is:

1. In a regulator for adjusting the active length of a balance-spring in a timepiece movement, of the type having an annular portion to be fitted on said movement coaxially with said balance-spring, a lug having a cut-out portion and an opening into said cut-out portion, and a first limiting member fitted in said cut-out portion and held rotatably adjustable about an axis parallel to the axis of rotation of said regulator, the improvement which comprises:

a second limiting member disposed opposite said first limiting member and formed by an integral lateral portion of said lug bent in a rounded bend, about a line running towards said opening, into a plane parallel to the axis of rotation of said regulator, and at least two straight, parallel, projecting banking elements respectively forming part of said first and said second limiting member, said banking elements being visible between said opening and said rounded bend when viewed at right angles in the dial-down position of said movement.

2. A regulator in accordance with claim 1, wherein said line running towards said opening runs in a substantially radial direction with respect to said annular portion.

3. A regulator in accordance with claim 1, wherein said second limiting member includes projecting means for axially retaining said balance-spring.

4. A regulator in accordance with claim 1, wherein said second limiting member includes a recess reducing the thickness of the one of said banking elements forming part of said second limiting member.

5. A regulator in accordance with claim 1, wherein said first limiting member comprises, at least on a side thereof remote from said annular portion, inclined surface means for preventing snagging of the inner turns of said balance-spring in the event of a shock.

6. A regulator in accordance with claim 1, wherein said cut-out portion includes two arcuate sectors and said first limiting member is a substantially cylindrical part comprising a bearing surface fitted between said two arcuate sectors, a head adjacent to said bearing surface, and a stem likewise adjacent to said bearing surface and exhibiting at least one flat having an edge forming one of said banking elements.

7. A regulator in accordance with claim 6, wherein said substantially cylindrical part includes a further flat positioned differently from said at least one flat, said further flat crossing said head and said bearing surface, whereby said edge remains visible.

8. A regulator in accordance with claim 7, wherein said at least one flat and said further flat form an angle of about 55–65°.

* * * * *